299-13

2/10/81 XR 4,249,603

United States Patent [19]

Skogen

[11] 4,249,603

[45] Feb. 10, 1981

[54] DOPING A RETORT WITH RADIOACTIVE NUCLIDES TO DETERMINE THE LOCUS OF A PROCESSING ZONE

[75] Inventor: Haven S. Skogen, Grand Junction, Colo.

[73] Assignee: Occidental Oil Shale, Inc., Grand Junction, Colo.

[21] Appl. No.: 972,869

[22] Filed: Dec. 26, 1978

[51] Int. Cl.[3] ..... E21B 43/247; E21B 43/263

[52] U.S. Cl. ..... 166/251; 166/252; 166/259; 299/2; 299/13

[58] Field of Search ..... 166/252, 251, 259, 247; 299/1, 2, 13; 175/39

[56] References Cited

U.S. PATENT DOCUMENTS

| | | | |
|---|---|---|---|
| 2,658,724 | 11/1953 | Arps | 175/39 |
| 3,011,566 | 12/1961 | Graham | 175/39 |
| 3,044,543 | 7/1962 | Ramey, Jr. | 166/251 |
| 3,116,450 | 12/1963 | Longwill | 324/2 |
| 3,661,423 | 5/1972 | Garrett | 299/2 |
| 3,678,883 | 7/1972 | Fischer | 175/39 X |
| 4,148,529 | 4/1979 | Burton | 299/1 |
| 4,149,592 | 4/1979 | Burton et al. | 166/64 |

OTHER PUBLICATIONS

Burwell et al., "Krypton 85 Tracer Aids Evaluation of Underground Combustion Oil-Recovery Tests", *Producers Monthly*, Jan. 1965, pp. 21-23.

*Primary Examiner*—Stephen J. Novosad
*Attorney, Agent, or Firm*—Christie, Parker & Hale

[57] ABSTRACT

The locus of a processing zone advancing through a fragmented permeable mass of formation particles in an in situ oil shale retort in a subterranean formation containing oil shale and which generates an effluent fluid is determined by placing a radionuclide source for providing an identifiable radionuclide, and monitoring effluent fluid from the processing zone for presence of such radionuclide. The radionuclide source provides radionuclide at a predetermined temperature.

29 Claims, 5 Drawing Figures

DOPING A RETORT WITH RADIOACTIVE NUCLIDES TO DETERMINE THE LOCUS OF A PROCESSING ZONE

CROSS-REFERENCES

This application is related to U.S. Patent Applications, Ser. No. 801,631, filed on May 31, 1977, by Robert S. Burton III and Carl Chambers, entitled CONTAINERS FOR INDICATORS now U.S. Pat. No. 4,149,592, issued on Apr. 17, 1979; Ser. No. 798,376, filed on May 9, 1977, by Robert S. Burton III, entitled USE OF CONTAINERS FOR DOPANTS TO DETERMINE THE LOCUS OF A PROCESSING ZONE IN A RETORT, now abandoned; and Ser. No. 869,668, filed on Jan. 16, 1978, by Robert S. Burton III, entitled DOPING A RETORT TO DETERMINE THE LOCUS OF A PROCESSING ZONE now U.S. Pat. No. 4,148,529, issued on Apr. 10, 1979, all of which are assigned to the assignee of this invention. These applications are incorporated herein by this reference.

BACKGROUND OF THE INVENTION

The presence of large deposits of oil shale in the Rocky Mountain region of the United States has given rise to extensive efforts to develop methods of recovering shale oil from kerogen in the oil shale deposits. It should be noted that the term "oil shale" as used in the industry is in fact a misnomer; it is neither shale nor does it contain oil. It is a sedimentary formation comprising marlstone deposit having layers containing an organic polymer called "kerogen," which upon heating decomposes to produce hydrocarbon liquid and gaseous products. It is the formation containing kerogen that is called "oil shale" herein, and the liquid hydrocarbon product is called "shale oil."

A number of methods have been proposed for processing oil shale which involve either first mining the kerogen bearing shale and processing the shale above ground, or processing the oil shale in situ. The latter approach is preferable from the standpoint of environmental impact since the spent shale remains in place, reducing the chance of surface contamination, surface distortion, and the requirement for disposal of solid wastes.

The recovery of liquid and gaseous products from oil shale deposits has been described in several patents, such as U.S. Pat. Nos. 3,661,423; 4,043,595; 4,043,596; 4,043,597; and 4,043,598, which are incorporated herein by this reference. Such patents describe in situ recovery of liquid and gaseous hydrocarbon materials from a subterranean formation containing oil shale by mining out a portion of the subterranean formation and then fragmenting a portion of the remaining formation to form a stationary, fragmented permeable mass of formation particles containing oil shale, referred to herein as an in situ oil shale retort. Hot retorting gases are passed through the in situ oil shale retort to convert kerogen contained in the oil shale to liquid and gaseous products.

One method of supplying hot retorting gases used for converting kerogen contained in the oil shale, as described in U.S. Pat. No. 3,661,423, includes establishment of a combustion zone in the retort and introduction of an oxygen containing retort inlet mixture into the retort as a gaseous combustion zone feed to advance the combustion zone through the retort. In the combustion zone oxygen in the combustion zone feed is depleted by reaction with hot carbonaceous materials to produce heat and combustion gas. By the continued introduction of the gaseous combustion zone feed into the combustion zone, the combustion zone is advanced through the retort. The combustion zone is maintained at a temperature lower than the fusion temperature of oil shale, which is about 2100° F., to avoid plugging of the retort, and above about 1100° F. for efficient recovery of hydrocarbon products from the oil shale.

The effluent gas from the combustion zone comprises combustion gas and any gaseous portion of the combustion zone feed that does not take part in the combustion process. This effluent gas is essentially free of free oxygen and contains constituents such as oxides of carbon and sulfurous compounds. It passes through the fragmented mass in the retort on the advancing side of the combustion zone to heat oil shale in a retorting zone to a temperature sufficient to produce kerogen decomposition, called retorting, in the oil shale to gaseous and liquid products and to a residue of solid carbonaceous material.

The liquid products and gaseous products are cooled by cooler particles in the fragmented mass in the retort on the advancing side of the retorting zone. The liquid hydrocarbon products, together with water produced in or added to the retort, are collected at the bottom of the retort and withdrawn to the surface through an access tunnel, drift or shaft. An off gas containing combustion gas generated in the combustion zone, gaseous products produced in the retorting zone, gas from carbonate decomposition, and any gaseous portion of the combustion zone feed that does not take part in the combustion process is also withdrawn to the surface.

It is desirable to know the locus of parts of the combustion and retorting processing zones as they advance through an in situ oil shale retort for many reasons. One reason is that by knowing the locus of such a processing zone, steps can be taken to control the orientation of the advancing side of the processing zone. It is desirable to maintain a processing zone which is flat and uniformly transverse and preferably uniformly normal to the direction of its advancement. If the combustion zone is skewed relative to its direction of advancement, there is more tendency for oxygen present in the combustion zone to oxidize hydrocarbon products produced in the retorting zone, thereby reducing hydrocarbon yield. In addition, with a skewed processing zone, more cracking of the hydrocarbon products can result. Monitoring the locus of parts of the processing zone provides information for control of the advancement of the processing zone to maintain it flat and uniformly perpendicular to the direction of its advancement to obtain high yield of hydrocarbon products.

Another reason for which it can be desirable to monitor the locus of the processing zone is to provide information so the composition of the combustion zone feed mixture can be varied with variations in the kerogen content of oil shale being retorted. Formation containing oil shale include horizontal strata or beds of varying kerogen content, including strata containing substantially no kergoen, and strata having a relatively high kerogen content such as having a Fischer assay of 80 gallons per ton. If combustion zone feed containing too high a concentration of oxygen is introduced into a region of a retort containing oil shale having a high kerogen content, oxidation of carbonaceous material in the oil shale can generate sufficient heat that fusion of the oil shale can result, thereby producing a region of the fragmented mass which cannot be penetrated by processing gases. High temperatures also can cause excessive endothermic carbonate decomposition to carbon dioxide and dilution of the off gas from the retort, thereby lowering the heating value of the off gas. Layers in the fragmented mass inherently correlate with strata in the unfragmented formation because there is little vertical mixing between strata when explosively fragmenting formation to form a fragmented permeable mass of formation particles. Therefore, samples of various strata through the retort can be taken before initiating retorting of the oil shale and assays can be conducted thereon to determine the kerogen content. Such samples can be taken from the fragmented mass, from formation before expansion, or from formation nearby the fragmented mass since little change in kerogen content of oil shale occurs over large areas of formation. Then, by monitoring the locus of the combustion zone as it advances through the retort, the composition of the combustion zone feed can be appropriately modified.

Another reason for monitoring the locus of the combustion and retorting processing zones as they advance through the retort is to monitor the performance of the retort to determine if sufficient shale oil is being produced in relation to the amount of oil shale being retorted.

Further, by monitoring the locus of the combustion and retorting processing zones, it is possible to control the advancement of these two zones through the retort at an optimum rate. The rate of advancement of the combustion and retorting processing zones through the retort can be controlled by varying the flow rate and composition of the combustion zone feed. Knowledge of the locus of the combustion and retorting processing zones allows optimization of the rate of advancement to produce hydrocarbon products of the lowest cost possible with cognizance of the overall yield, fixed costs, and variable costs of producing the hydrocarbon products.

Thus, it is desirable to provide methods for monitoring advancement of combustion and retorting processing zones through an in situ oil shale retort.

BRIEF SUMMARY OF THE INVENTION

The present invention concerns a method for determining the locus of a processing zone, such as a combustion zone and a retorting zone, advancing through a fragmented permeable mass of formation particles in an in situ oil shale retort in a subterranean formation containing oil shale, wherein an effluent fluid is produced during processing. The method comprises the steps of placing at a selected location in the formation within the boundaries of an in situ oil shale retort to be formed in the formation, a radionuclide source for providing radionuclide at a predetermined temperature greater than ambient. The formation within the boundaries of the in situ oil shale retort to be formed is explosively expanded forming an in situ oil shale retort containing a fragmented permeable mass of formation particles containing oil shale, and containing the radionuclide source. The processing zone is advanced through the fragmented mass for forming at least one effluent fluid and for providing radionuclide from the radionuclide source. Such an effluent fluid from the retort is monitored for presence of radionuclide to determine the locus of the processing zone.

The temperature at which the radionuclide is provided by the radionuclide source depends upon the locus of which processing zone is being determined. For example, if the processing zone is the retorting zone, the radionuclide can be provided at a temperature characteristic of the retorting zone. If the processing zone is a combustion zone, the radionuclide can be provided at a temperature characteristic of the combustion zone.

A plurality of radionuclide sources can be provided at a plurality of selected locations spaced apart from each other for monitoring the locus of a processing zone. Such radionuclide sources can be spaced apart from each other along the direction of advancement of the processing zone for monitoring the locus of the processing zone as it advances through the fragmented mass. In addition, such radionuclide sources can be spaced apart from each other in a plane substantially perpendicular or normal to the direction of advancement of the processing zone for determining if the processing zone is skewed and/or warped.

When using a plurality of such radionuclide sources, radionuclide sources which provide different radionuclides can be used to ascertain the configuration and the locus of the processing zone. Also, by using radionuclide sources for providing a first radionuclide at a temperature characteristic of the combustion zone, and a second different radionuclide at a temperature characteristic of the retorting zone, the locus of both the combustion and retorting processing zones can be determined.

DRAWINGS

These and other features, aspects and advantages of the present invention will become more apparent upon consideration of the following description, appended claims, and accompanying drawings where:

FIG. 1 represents in horizontal cross section an in situ oil shale retort having radionuclide sources;

FIG. 2 which is taken on line 2—2 in FIG. 1, schematically represents in vertical cross section the in situ oil shale retort of FIG. 1;

DETAILED DESCRIPTION OF THE INVENTION

Figure 2:
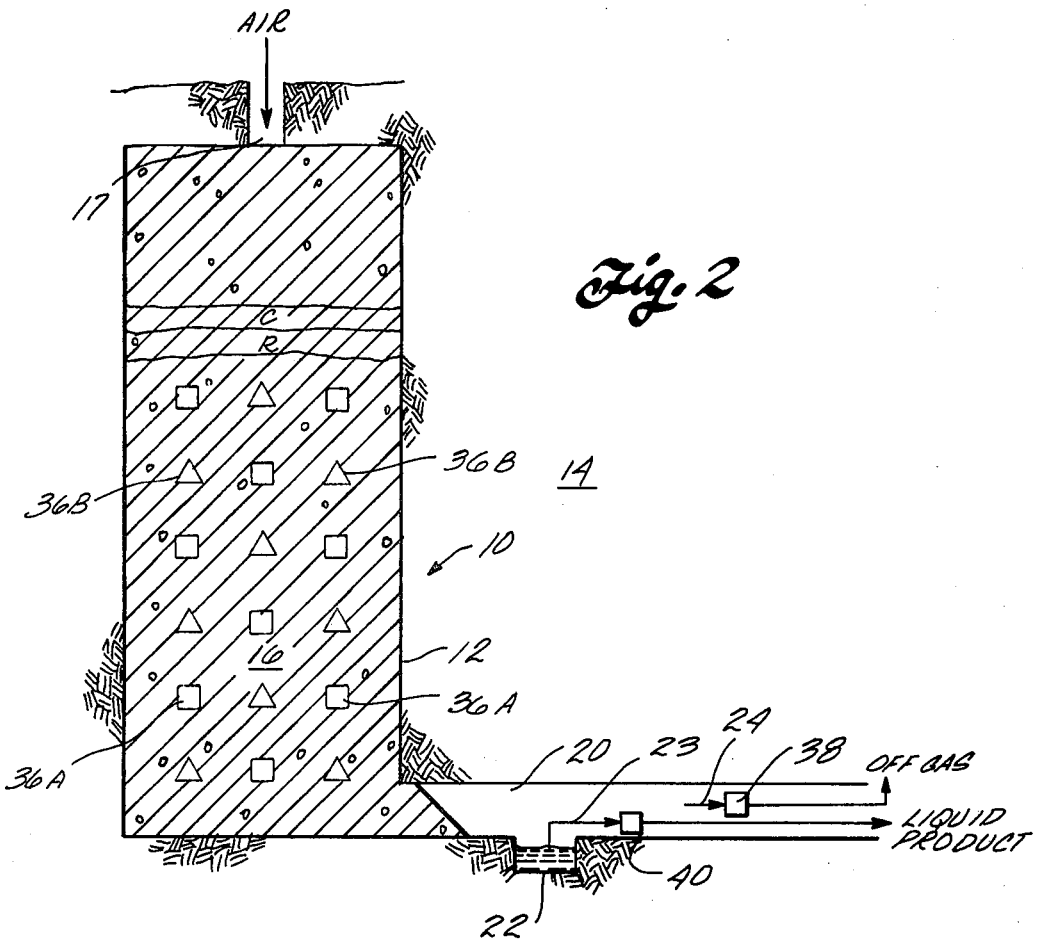
Figure 1:
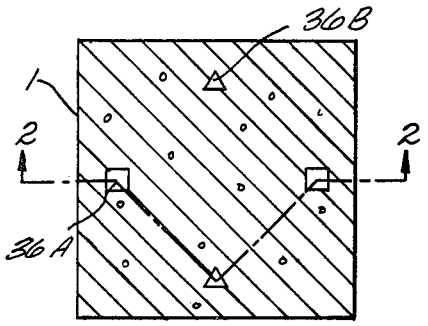

Referring to FIGS. 1 and 2, an in situ oil shale retort 10 is in the form of a cavity 12 formed in a subterranean formation 14 containing oil shale. The cavity contains a fragmented permeable mass 16 of formation particles containing oil shale. The cavity 12 can be created simultaneously with the fragmentation forming the mass 16 of formation particles by blasting, utilizing any of a variety of techniques. A desirable technique involves excavating or mining a void within the boundaries of an in situ oil shale retort site to be formed in the subterranean formation and explosively expanding remaining oil shale in the formation toward such a void. A method of forming an in situ oil shale retort is described in U.S. Pat. No. 3,661,423. A variety of other techniques can also be used.

A conduit 17 communicates with the top of the fragmented mass 16 of formation particles. During the retorting operation of the retort 10, a combustion processing zone C is established in the retort and advanced by introducing an oxygen containing retort inlet mixture such as air, or air mixed with other fluids, into the in situ oil shale retort through the conduit 17 as a combustion zone feed. The combustion processing zone is that portion of the retort wherein the greater part of the oxygen in the combustion zone feed that reacts with residual carbonaceous material in retorted oil shale is comsumed. Oxygen introduced to the retort in the combustion zone feed oxidizes carbonaceous material in the oil shale to produce combustion gas. Heat from the exothermic oxidation reactions, carried by flowing gases, advances the combustion zone through the fragmented mass of formation particles.

Combustion gas produced in the combustion zone and any unreacted portion of the combustion zone feed pass through the fragmented mass of formation particles on the advancing side of the combustion zone to establish a retorting processing zone R on such advancing side of the combustion zone. Kerogen in the oil shale is retorted in the retorting zone to produce liquid and gaseous products.

There is an access tunnel, adit, drift or the like 20, in communication with the bottom of the retort. The drift contains a sump 22 in which liquid products 23, including water and liquid hydrocarbon products (shale oil), are collected to be withdrawn. An off gas 24 containing gaseous products, combustion gas, carbon dioxide from carbonate decomposition, and any unreacted gaseous portion of the combustion zone feed is also withdrawn from the in situ oil shale retort 10 by way of the drift 20. The liquid products and off gas are withdrawn from the retort as effluent fluids.

Retorting of oil shale can be conducted with combustion zone temperatures as low as about 800° F. However, for economically efficient retorting, it is preferred to maintain the combustion zone at least at about 1100° F. The upper limit for the temperature in the combustion zone is determined by the fusion temperature of oil shale, which is about 2100° F. The temperature in the combustion zone preferably is maintained below about 1800° F. to provide a margin of safety between the temperature in the combustion zone and the fusion temperature of the oil shale.

Placed at selected locations in the fragmented permeable mass 16 of formation particles in the retort 10 are radionuclide sources 36A and 36B. As used herein, the term "radionuclide" refers to any radioactive nuclide of any of the chemical elements which will produce detectable radioactive emission such as through alpha, beta or gamma decay. Each radionuclide source provides radionuclide at a predetermined temperature greater than ambient and less than the maximum temperature in the retort, i.e., less than about 2100° F. The radionuclide sources can be spaced equidistant from each other or at any selected spacing. Radionuclide sources for providing radionuclide are referred to herein as "radionuclide source," "doping material," and "dope."

The radionuclide source can be a chemical substance having a radionuclide or an apparatus for providing a radionuclide. Suitable apparatus includes a container confining a radionuclide whereby the container releases the radionuclide at a predetermined temperature greater than ambient and less than the maximum temperature in the retort. Use of a container as a radionuclide source is described herein and in the aforementioned United States Patent Application Ser. Nos. 801,631 and 798,376.

Radioactive emission detection instruments can be provided for monitoring effluent fluid from the retort for presence of radionuclide. For example, monitoring instruments 38 can be provided for monitoring the off gas 24 for presence of radionuclide. Similarly, monitoring instruments 40 can be provided for monitoring the liquid products 23 for presence of radionuclide. The water and/or liquid hydrocarbons withdrawn from the retort can be monitored.

When a container is used and a radioactive chemical substance is placed in the container as a radionuclide source, material released by the container is not necessarily the same as the radioactive chemical substance initially placed in the container. For example, the material released by the container can be a thermal decomposition product of the radioactive chemical substance originally placed in the container. The radionuclide for which monitoring is conducted, however, is the radionuclide originally present in and released by the container, although the manner in which the radionuclide is bonded may have changed. Radionuclide present in effluent gas or liquid from the retort can be the radionuclide source released by a container, the reaction product of a reaction in which a radionuclide source is a reactant, the reaction product in which one of the reactants is a radionuclide source, a thermal decomposition product of a radionuclide source and the like. For example, when a container confining calcium carbonate, wherein a portion of the carbon in the carbonate is $C^{14}$ as the radionuclide source, effluent gas from the retort can be monitored for radioactivity. The radioactivity exhibited by the radionuclide $C^{14}$ is present in the effluent gas as carbon dioxide produced as a result of the thermal decomposition of the calcium carbonate.

Any radionuclide can be selected for use as a radionuclide source in the practice of the method of this invention. A limiting factor to be considered in the selection of a radionuclide is the half-life of the radionuclide. A radionuclide having a relatively short half-life in comparison to the amount of radionuclide and amount of time it is in the retort, can decay after having been placed in the retort to such an extent that any radioactive decay through alpha, beta or gamma radiation can be immeasurable. For example, $O^{14}$ and $O^{19}$ have little utility as the half-life for each is 72 and 29.4 seconds respectively. Due to the amount of time generally required for forming a retort and retorting the retort, it is preferred to use a radionuclide source which provides a radionuclide having a relatively long half-life. In the use of a radionuclide having a relatively short half-life in comparison with the length of time of retorting, the effect of such a short half-life can be compensated for by providing a greater initial quantity of radionuclide in the radionuclide source. Another limiting factor in selecting a radionuclide source is the type and energy of the radiation provided by the radionuclide. It is undesirable to select a radionuclide source which provides a radionuclide having an emission that can be hazardous to the health of the people working on an in situ retort project. It is preferred that the radionuclide source provides a radionuclide in relatively small quantities which such small quantities are easily recoverable or pose little danger to the health and safety of the people working around a retort. Use of such relatively small quantities does not hinder detecting the radionuclide as the sophisticated radiation detection equipment used to monitor the effluent withdrawn from the retort can detect the presence of minute quantities of such radionuclides.

A particularly preferred radionuclide for use in monitoring the locus of a processing zone is $Kr^{85}$ (krypton-85). $Kr^{85}$ is particularly preferred because it does not react with other materials present in the retort and is not deleteriously affected by the physical conditions present during retorting. Krypton is nonreactive and, therefore, there is no possibility of exchange with the liquid effluent from the retort or a solution in the liquid being formed. For example, if $C^{14}$ were used as a radionuclide source, such $C^{14}$ could react and be found in either the gas or liquid effluent. $Kr^{85}$ also has a reasonable half-life of 4.5 hours which is sufficient for use as a radionuclide source. $Kr^{85}$ has three radioactive decay modes, all of which are of relatively low energy. $Kr^{85}$ first has a decay by negative beta emission of 0.82 MeV, the second decay is through gamma radiation of 0.150 MeV and a third decay mode by an isomeric transition which occurs by the emission of unconverted 0.305 MeV gamma rays. Further, since $Kr^{85}$ is unreactive, it can be readily recovered from the effluent fluid from the retort and thereby prevent loss of the radioactive material. Recovery of substantially all of the radionuclide is an important quality for selecting the proper radionuclide for avoiding potential health hazards and pollution problems arising upon non-recovery of the radionuclides.

As radioactivity, such as in the form of alpha, beta, and gamma emission, is being monitored for determining the locus of a processing zone, the chemical zone in which the radionuclide exists as it is withdrawn from the retort is of little importance to the detection of the radiation emitted by the radionuclide. The radionuclide will emit the alpha, beta, or gamma radiation regardless of how the particular radionuclide is bonded or whether it is present in the gas or liquid phase. The chemical reactivity of a particular radionuclide is important in determining and separating the radionuclides from the effluent fluid from the retort when using a plurality of different radionuclides.

The radionuclide source can provide a radionuclide of an element which element is normally present in the effluent fluid from the retort, as only the radionuclide emits the necessary radiation to be monitored. The radionuclide source needs to be provided in a sufficient concentration in the fragmented mass such that a detectable level of radiation is emitted in effluent fluid from the retort. The amount of radionuclide required in a radionuclide providing means depends on the nature and properties of the selected radionuclide such as its half-life, type of radioactive decay, energy of emission and its chemical properties such as whether it reacts under the conditions existing in the retort and whether it is in gaseous or liquid phase in the effluent fluid.

When different radionuclide are used in the retort such as for distinguishing between the retorting processing zone and combustion processing zone or for determining the configuration of the locus of the processing zones, the different radionuclides can be separated and then separately monitored in the effluent fluid by separation techniques known in the nuclear and radiochemical arts. For example, the different radionuclides can be separated if the different radionuclides are present in the gas phase, by passing the effluent gas from a retort through a packed column wherein the radionuclides have different flow rates. The individual radionuclides are separately detected upon exiting the column. When the different radionuclides provided have different chemical properties they can be separated by such difference in chemical properties. For example, when the radionuclides provided are $C^{14}$ from calcium carbonate and $Kr^{85}$, and $C^{14}$ is present in the effluent gas as carbon dioxide and the $Kr^{85}$ is unreactive with other chemicals present in the effluent gas. The carbon dioxide containing $C^{14}$ can be separated by bubbling the effluent gas through a water bath entrapping the carbon dioxide thus separating the $C^{14}$ from the $Kr^{85}$. Many methods can be used dependent upon the radionuclides being detected and the particular chemical properties of the chemical molecule associated with the radionuclide to be detected. The detecting instruments can also be used to detect the separate radioactive emissions of the various radionuclides by screening out radioactive emission having less than a certain threshold energy level.

Additionally, radiation detection instruments can be used which can discriminate between energy levels of emission or discriminate between types of emission.

Detection instruments measuring the presence of the radionuclide in the effluent fluid from the retort can be any radiation detection means such as conventional radiation detection and measurement apparatus. Included in such apparatus are the ion collection instruments such as: direct current instruments; vibrating-reed electrometers; ion chambers with pulse amplifiers; solid state detectors using insulating crystals as counters or semiconductors as ion chambers; multiplicative ion collection instruments; proportional counters; Geiger-Muller counters, and the like. Also, methods of detection not based on ion collection can be used such as using photographic film, cloud chambers, bubble chambers and spark chambers. Counters based upon light emission, scintillation counters and Cerenkov counters can also be used.

Using a radionuclide source for determining the locus of a processing zone is advantageous in that very small quantitites of a radionuclide can be determined by using some of the above-mentioned instruments and methods. The primary limiting factor in determining small quantities is interference by background radiation in detecting the radiation attributable to the radionuclide. By properly eliminating background radiation or by carefully determining a standard for such background, it is possible to detect the presence of minute quantities of the radionuclide.

Exemplary of a radionuclide source is $K^{85}$. By doping the retort 12 with a container confining $Kr^{85}$ and monitoring off gas 24 for the presence of $Kr^{85}$, the locus of a processing zone advancing through the fragmented permeable mass 16 in the retort 10 can be determined. Monitoring instruments 38 for radioactivity can be provided in the drift for detecting the presence of $Kr^{85}$ in the off gas 24. Suitable radiation detection means include proportional counters, Geiger-Muller tubes, and the like.

Another radionuclide source is $CaC^{14}O_3$. At about 825° C., calcium carbonate decomposes to release carbon dioxide. The presence of $C^{14}O_2$ indicates that the combustion zone has reached the portion of the fragmented mass doped with the $CaC^{14}O_3$.

Several radionuclide sources which provide radionuclide at different temperatures can be used. For example, a first radionuclide source 36A can provide radionuclide at a temperature characteristic of the combustion processing zone. A second radionuclide source 36B can provide radionuclide at a temperature characteristic of the retorting processing zone. Thus, as the combustion processing zone reaches such a first radionuclide source 36A, radionuclide is provided, and as the retorting processing zone reaches such as second radionuclide source 36B, radionuclide is provided. Preferably the radionuclide provided by such first and second radionuclide sources are different from each other so that the locus of both the retorting and combustion processing zones can be determined.

It is a preferred method that a plurality of radionuclide sources are placed in the retort spaced apart from each other along the direction of advancement of a processing zone through the fragmented mass so the locus of the processing zone can be determined at various times as the processing zone advances. When the combustion and retorting zones are advancing downwardly or upwardly through the retort, such radionuclide sources can be vertically spaced apart from each other.

As exemplified in FIG. 2, a plurality of first radionuclide sources 36C an be located vertically spaced apart within the retort. Preferably, the first radionuclide source 36A at the different elevations within the retort provide different radionuclides from each other. In this manner the advancement of the locus of the processing zones can be monitored. Similarly, if the processing zones advance transverse to the vertical of the retort, the radionuclide sources 36A located in a vertical plane can provide a different radionuclide than the radionuclide sources 36A located in a different vertical plane. It is sufficient for determining whether a processing zone is warped or skewed if the first radionuclide sources 36A in adjacent planes provide different radionuclides. In this manner the same first radionuclide sources can be used in nonadjacent planes within the retort normal to the advancement of the processing zone. As with the first radionuclide source 36A, the second radionuclide source 36B can also be varied such that the radionuclide sources 36B located in different planes within the retort provide different radionuclides from each other, or preferably at least each other in adjacent planes normal to the direction of advancement of the processing zone.

It is most preferred that each radionuclide source provide a different detectable radionuclide than the radionuclide provided by the adjacent radionuclide sources. This manner of arrangement of the radionuclide sources allows for monitoring the configuration of the processing zone by allowing detection of the location of any warp or skew of the locus of the processing zone. By knowing the aberration of the processing zone appropriate measures can then be taken to correct it.

Preferably at least two radionuclide sources for a processing zone are placed in the retort in a plane substantially normal to the direction of advancement of the processing zone through the fragmented means. For example, when a processing zone is advancing downwardly or upwardly through the fragmented mass, two or more radionuclide sources are laterally spaced apart from each other at the same elevation in the retort. This permits determination of whether the processing zone advancing through the fragmented permeable mass is flat and uniformly transverse to its direction of advancement, or if the processing zone is skewed and/or warped. When the monitoring instrument detects a quantity or type of radionuclide commensurate with release of radionuclide by the two or more radionuclide sources in the plane, there is an indication that the processing zone is uniformly transverse to its direction of advancement. It is most preferred that at least three radionuclide sources are provided in the retort in a plane substantially normal to the direction of advancement of a processing zone through the fragmented mass. At least three radionuclide sources are most preferred because, as a matter of geometry, it takes three points to define a plane. Use of only two radionuclide sources does not provide sufficient information to determine whether a processing zone is skewed unless the direction of skewing happens to coincide with the position of the sources.

Radionuclide sources spaced apart from each other along the direction of advancement of a processing zone and radionuclide sources spaced apart from each other in a plane normal to the direction of advancement of a processing zone, can be used in combination for determining if a processing zone is skewed and/or warped throughout the retorting process.

Preferably, a radionuclide source which provides a radionuclide detectable in the off gas is used. This requires that at least a portion of the radionuclide is in the vapor phase at the temperature and pressure of the off gas. An advantage of using a radionuclide detectable in the off gas is that the composition of the off gas is more quickly responsive to changes in the retorting process than is the composition of the liquid product stream 23. This is cause liquid products tend to "hang up" in the retort; i.e., flow is retarded by contact between the liquids and the fragmented mass. For example, delays of as much as a week between initiation of retorting and collection of liquid products in the sump 22 can occur. When a radionuclide detectable only in the water and/or hydrocarbon products is used, a lag time of as much as a week can occur between movement of the processing zone through a region in which a container confining radionuclide sources is located and detection of radionuclide in the effluent liquid from the retort. On the other hand, gases can pass downwardly through a retort at about five feet per minute and faster.

The radionuclide sources can be placed at selected locations within the boundaries of a retort to be formed in the subterranean formation 14 by drilling boreholes downwardly from the ground surface or from a subterranean working level or base of operation above the retort to be formed, by drilling boreholes upwardly from a production level below the retort to be formed, and/or by drilling boreholes from a work level between the top and bottom of the retort to be formed. Then radionuclide sources, such as containers, are placed into such boreholes within the boundaries of the retort to be formed.

When placing radionuclide sources within the retort boundaries from above the retort, the radionuclide sources can be lowered into the boreholes, preferably suspended from a measuring rope for accurate determination of the elevation in the retort where a radionuclide source is placed. Stamping, which is an inert material typically used in shotholes between adjacent charges and between an explosive charge and the other end of a shothole, can be used between radionuclide sources in the boreholes. The stemming can be sand, gravel, or crushed oil shale.

Preferably, for ease of placement, the radionuclide sources are placed in unfragmented formation in the retort site prior to blasting to form the cavity 12 and the fragmented mass 16.

Figure 4:
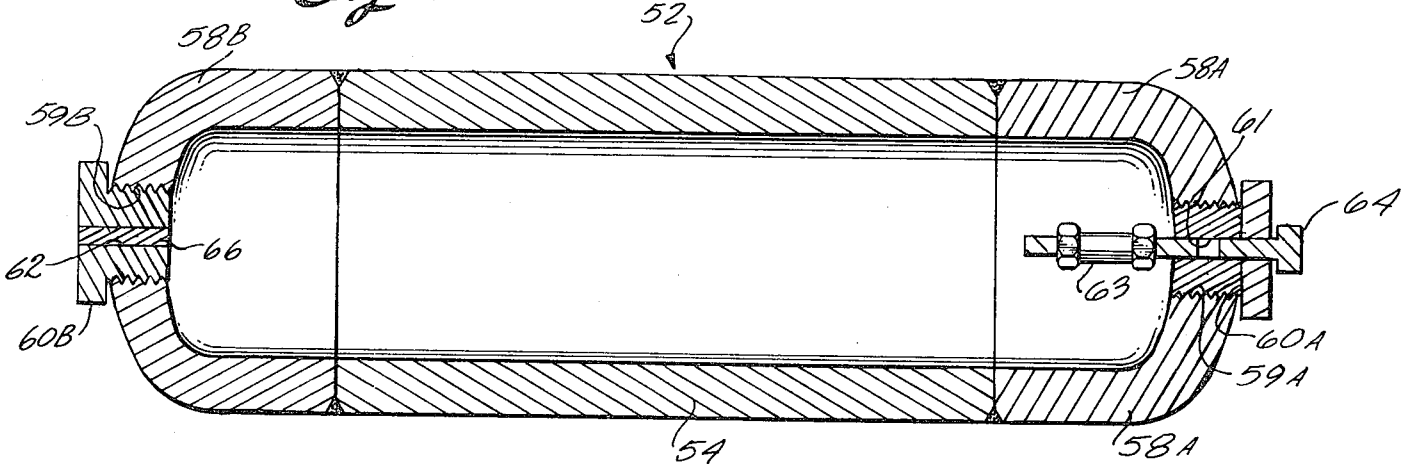
FIG. 4 shows in partial cross section a container for confining radionuclide source for use with the retorts of FIG. 2.

Container means 52 useful for confining a fluid radionuclide source and releasing the radionuclide source at a selected temperature is shown in FIG. 4 and more fully described in Patent Application Ser. Nos. 801,631 and 798,376. The container 52, which is particularly useful for gaseous radionuclide source is referred to herein as a "gas bomb." Such a gas bomb can also be used for confining a liquid or solid radionuclide source. The container 52 comprises a cylindrical pipe 54 capped at both ends with welded on caps 58A and 58B.

A filling mechanism is provided with a threaded plug 60A in a threaded hole 59A in one of the end caps 58A, and a discharging mechanism is provided with a threaded plug 60B in a threaded hole 59B in the other end cap 58B.

A fill hole 61 is provided through one of the plugs 60A, and a release hole 62 is provided through the other plug 60B. The fill hole 61, which is threaded, holds a check valve 63 having an elastomeric seal. The container is filled through the check valve which prevents premature release of radionuclide. Since the elastomeric seal of the check valve 63 can degrade at the high temperatures of retorting, the exterior end of the fill hole 61 is closed with a plug 64 to prevent premature release of the contents of the container 52. The release hole 62 contains means for preventing release of the radionuclide at a temperature less than the preselected temperature and for releasing the radionuclide at the preselected temperature. A fusible cast plug 66 is provided in the release hole 62 for release of the radionuclide.

The material for the fusible plug is one which fuses at the temperature at which it is desired to release the radionuclide. Zinc, which melts at about 787° F., can be used. It is believed that in practice the zinc plug melts at a temperature characteristic of the retorting zone.

Other materials which can be used for the plug include aluminum, aluminum alloys, lead, silver, brass, bronze, and magnesium alloys. For example, naval brass, which melts at 1625° F., can be used to release a radionuclide at a temperature corresponding to the combustion zone. By providing a first set of containers having naval brass plugs and confining a first type of radionuclide and a second set of containers having zinc plugs and confining a second type of radionuclide, where the radionuclide provided by the first and second types of radionuclide sources are different from each other, the locus of both the retorting and combustion processing zones can be determined.

Figure 5:
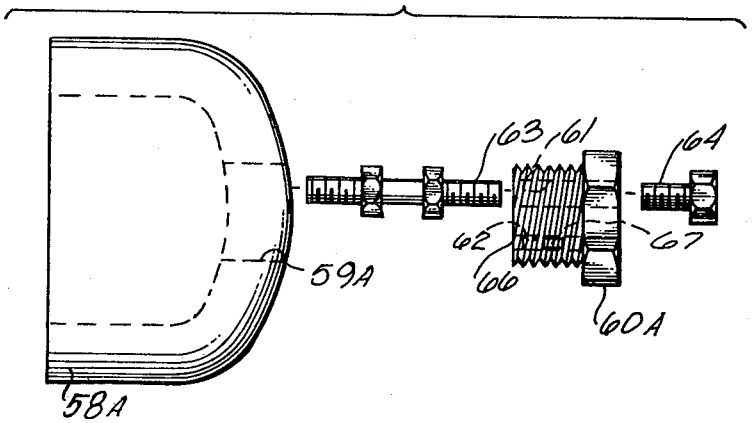
FIG. 5 is an exploded elevation view of a portion of another version of a container confining radionuclide source.

Another version of a gas bomb is shown in FIG. 5. In this version, pressure break diaphragm or rupture disc 67 responsive to high pressure in the container due to increase in the temperature of the radionuclide source is provided in the release hole 62A rather than a fusible plug. Another difference between the versions of FIGS. 4 and 5 is that both a fill hole 161A and a release hole 162A are provided through the same plug 160A in FIG. 5.

The size of the container 52 provided for releasing a radionuclide is dependent upon the desired concentration of the radionuclide in the effluent fluid from the retort.

The container and plug used for confining the radionuclide must have sufficient strength to survive blasting to form the fragmented permeable mass when the container is placed in the retort prior to blasting. In addition, the container must be able to withstand the high temperatures and corrosive environment present in the retort for at least a sufficient time to prevent premature release of the radionuclide. Corrosion of the container can be caused by sulfurous compounds present in gases passing through a retort. When a volatile radionuclide is used as the radionuclide source, the container must be able to resist the internal pressures developed in the container due to heating of the volatile radionuclide prior to its release at the selected temperature. Also, internal corrosion can be a problem when using certain chemical compounds as the radionuclide source. Therefore, the choice of container material can be critical. Suitable materials for forming a container include Monel nickel-copper alloy, Inconel nickel-chromium alloy, and carbon steel of sufficient thickness that it does not corrode through before release of the radionuclide.

Techniques utilizing features of this invention are demonstrated by the following examples.

EXAMPLE 1

Figure 3:
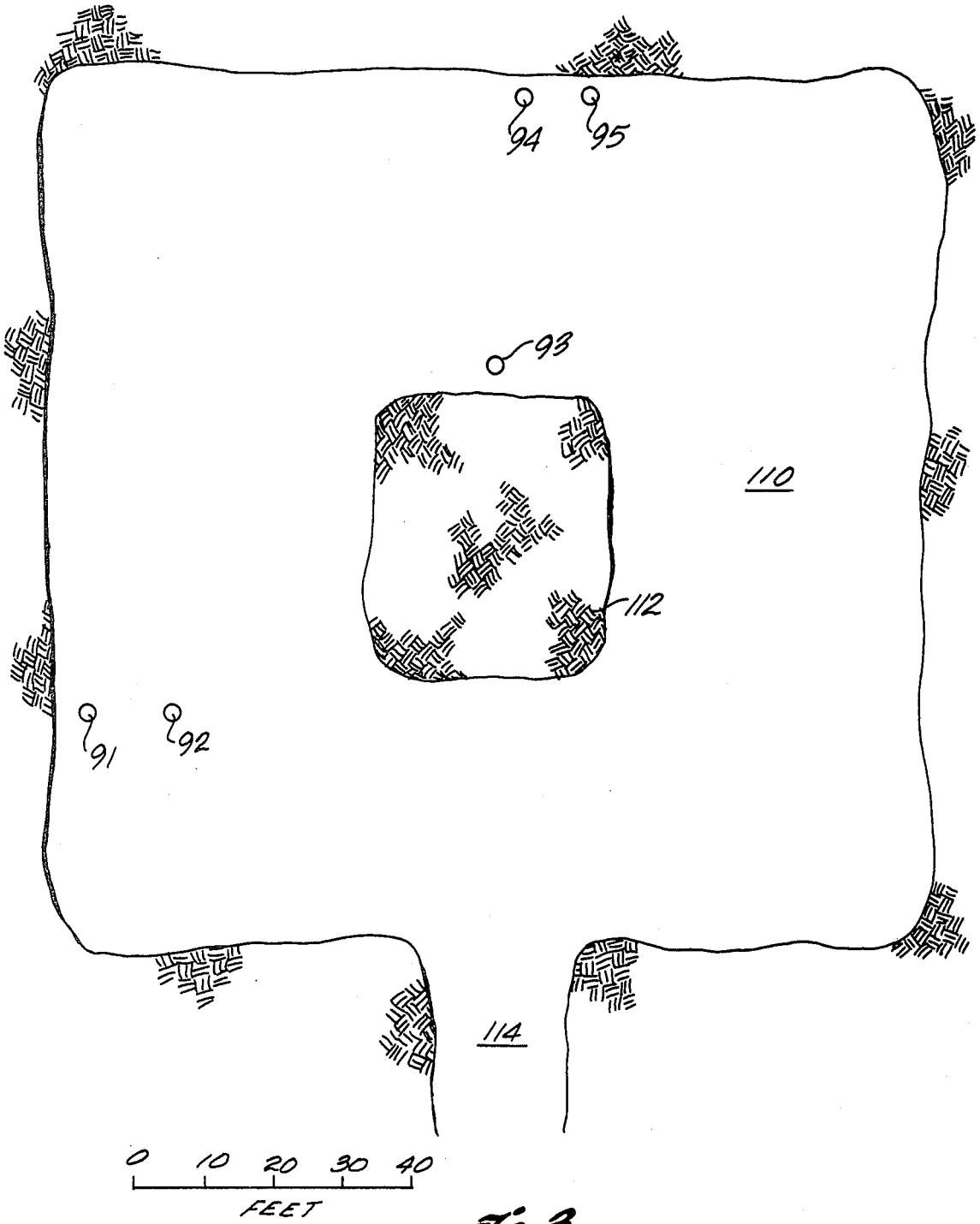
FIG. 3 is an overhead plan view of a work area for an in situ oil shale retort showing placement of a plurality of radionuclide sources in the retort for monitoring the locus of a processing zone in the retort.

FIG. 3 is an overhead plan view of a working level room 110 useful in forming an in situ oil shale retort in the south/southwest portion of the Piceance Creek structural basin in Colorado. Below the working level room is unfragmented formation which is to be expanded to form a fragmented mass of formation particles in the retort. The workroom is about 120 feet square, about the same dimensions as the fragmented mass in the retort. The fragmented mass to be formed extends downwardly into the formation for about 232 feet below the floor of the room 110. A central pillar 112 of unfragmented formation is left in place to support the roof of the working level room. A drift 114 is provided for access to the workroom.

Prior to forming the fragmented mass, the retort is doped with the containers containing radionuclide as the radionuclide source. The containers, i.e., gas bombs, used for the radionuclide sources are prepared in accordance with the design shown in FIG. 4. Each container is formed from a six inch long piece of carbon steel pipe 54 having a nominal diameter three inches, with 0.6 inch wall thickness. Three inch end caps 58A and 58B are welded on the pipe. The filling mechanism is built into a one inch NPT hex plug 60A located in the end of one of the caps 58A and the discharge mechanism is built into a one inch NPT hex plug. A threaded hole 59 is provided for each one inch hex plug. A threaded fill hole 61 in the plug 60A of the fill mechanism is provided for a ¼ inch check valve 63. The outer end of the fill hole is sealed with a ¼ inch NPT plug 64 after filling the cylinder with a radionuclide-containing chemical compound.

A ⅛ inch release hole 62 in the plug 60B of the release mechanism is threaded full length with a 10–32 thread for extra bonding surface to avoid premature extrusion of the fusible plug from the hole as the plug softens at elevated temperatures. The release hole 62 is filled with a cast-in-place fusible plug 66 of pure zinc. The length of the hex plug 60B and the zinc plug 66 is about 1¼ inches.

The 0.6 inch wall thickness and short cylinder length of this bomb provide a strong, compact container capable of surviving a blast for forming the cavity and fragmented permeable mass of the retort of FIG. 3. Because of the use of a pure zinc metal plug, it is expected that the radionuclide used in the container is released at about 787° F.

The placement of the gas bombs in the retort is shown in FIG. 3. Prior to blasting to form the retort, five bore holes 91, 92, 93, 94, and 95 are formed by drilling downwardly from the floor of the working level room into the portion of the formation to be fragmented by blasting to form the retort.

A bomb containing a radionuclide is placed about 2½ feet down into bore hole 91, which has a 9½ inch diameter. Bore hole 92, which is 6½ inches in diameter, contains two bombs. One bomb is placed 87 feet down in the hole 92 and the other bomb is placed 10 feet down. Stemming with formation particles is used between the bombs; i.e., formation particles are poured into the bore hole for filling.

Bore hole 93 is 4½ inches in diameter and contains one bomb. The bomb is placed one foot down in the bore hole 93 and is stemmed with formation particles.

Bore hole 94 is 6¼ inches in diameter and contains one bomb five feet down with formation particle stemming.

Bore hole 95 has a 6¼ inch diameter and three bombs are placed 174, 116 and 77 feet down the hole. Stemming with formation particles is used for the bottom bomb, sand stemming is used for the middle bomb, and no stemming to the top is used for the top bomb.

After placement of the bombs, formation is explosively expanded to form an in situ oil shale retort containing a fragmented permeable mass of formation particles containing oil shale. Subsequently oil shale in the fragmented mass is retorted, producing an effluent fluid which is withdrawn from the retort.

The effluent fluid is monitored with a Geiger-Muller counter. When radiation is first detected in the effluent fluid, such radiation can be attributable to the highest positioned radionuclide source in the retort, therefore, the processing zone is about at the level of such radionuclide source. As the processing zone advances downwardly in the retort, it reaches such radionuclide sources at successively lower elevations in the retort, providing more radionuclide during later stages of the retorting process. The effluent fluid is constantly monitored to determine the locus of the processing zone.

The bomb depths presented above are measured with a measuring rope to the lower end of the bomb. The fusible plug is always oriented upwardly and is about one foot higher than the depth indicated. However, this could be offset by dropping of a bomb during blasting. It is estimated that during blasting to form the cavity and expand formation particles to form the fragmented permeable mass, bombs drop on an average of about two feet. Therefore, it is estimated that the contents of the bombs are released at about one foot lower than the depth the bomb is placed in the bore hole.

EXAMPLE 2

As described by FIG. 3 and in Example 1, a working level room 110 is excavated for forming an in situ oil shale retort within a subterranean formation containing oil shale. Below the working level is unfragmented formation which is to be expanded for forming a fragmented mass of formation particles in the retort. The workroom is about 120 feet square, about the same dimensions as the fragmented mass in the retort. The fragmented mass to be formed extends downwardly into the formation for about 232 feet below the floor of the room 110. A central pillar 112 of unfragmented formation is left in place to support the roof of the working level room. A drift 114 is provided for access to the working level room.

Prior to forming the fragmented mass, the retort is doped with containers containing krypton-85 ($Kr^{85}$) as the radionuclide. The containers, i.e., gas bombs, used for the radionuclide are prepared in accordance with the design shown in FIG. 4. Each container is formed from a six inch long piece of carbon steel pipe 54 having a nominal diameter of three inches, with 0.6 inch wall thickness. Three inch end caps 58A and 58B are welded on the pipe. The filling mechanism is built into a one-inch NPT hex plug. A threaded hole 59 is provided for each one inch hex plug. A threaded fill hole 61 in the plug 60A of the fill hole 61 in the plug 60A of the fill mechanism is provided for a ¼ inch check valve 63. The outer end of the fill hole is sealed with a ¼ inch NPT plug 64 after filling the cylinder with krypton gas containing some $Kr^{85}$.

A ⅛ inch release hole 62 in the plug 60B of the release mechanism is threaded full length with a 10–32 thread for extra bonding surface to avoid premature extension of the fusible plug from the hole as the plug softens at elevated temperatures. The release hole 62 is filled with a cast-in-place fusible plug 66 of pure zinc. The length of the hex plug 60B and the zinc plug 66 is about 1¼ inches.

The 0.6 inch wall thickness and short cylinder length of the bomb provide a strong, compact container capable of surviving a blast for forming the cavity and fragmented permeable mass of the retort of FIG. 3. Because of the use of a pure zinc metal plug it is expected that the radionuclide used in the container are released at about 787° F.

A total of eight such gas bombs are filled with krypton gas having varying concentrations of $Kr^{85}$. The eight containers contain 100, 150, 200, 400, 650, 900, 1000, and 1100 millicuries of $Kr^{85}$ respectively.

The four gas bombs containing 650, 900, 1000 and 1100 millicuries of $Kr^{85}$ are placed in the retort prior to blasting by drilling four bore holes downwardly from the floor of the working level room into the portion of the formation to be fragmented by blasting to form the retort. The four gas bombs are each then lowered into each of the bore holes. These four gas bombs are lowered to a depth of 150 feet from the floor of the working level room. The four gas bombs thereby lie in a horizontal plane 150 feet below the floor of the working level room. The bore holes are then stemmed with formation particles.

The remaining four gas bombs containing 100, 150, 200 and 400 millicuries of $Kr^{85}$ are then each lowered into the four bore holes to an elevation 80 feet below the floor of the working level room. These four gas bombs thereby form a plane 80 feet below the floor of the working level room. The remaining portion of the bore holes are stemmed with formation particles.

After placement of the bombs, the formation is explosively expanded to form an in situ oil shale retort containing a fragmented permeable mass of formation particles containing oil shale. Subsequently, oil shale in the fragmented mass is retorted by establishing a processing zone in the fragmented mass thereby producing an effluent fluid which is withdrawn from the retort.

The effluent fluid is monitored with a scintillation counter for the presence of radiation. By measuring the radiation present in the off gas and integration of the results, it can be determined which one or which combination of gas bombs released $Kr^{85}$. By determining the time period during which all four gas bombs in one plane release the $Kr^{85}$, it can be determined if the processing zone is relatively flat or whether the processing zone is warped or skewed.

With the use of two such planes in one retort, the processing zone can be monitored at two levels. By increasing the number of radionuclide sources and number of planes defined thereby and depending on instrument sensitivity, it is possible to have a twenty-four hour monitoring system of a processing zone.

Monitoring the locus of the processing zone advancing through the fragmented permeable mass 16 in the retort 10 has significant advantages. For example, steps can be taken to maintain the combustion zone flat and uniformly perpendicular to the direction of its advancement to minimize oxidation and excessive cracking of hydrocarbons produced in the retorting zone. In addition, the rate of introduction and composition of the retort inlet mixture can be controlled to maintain the temperature in the combustion zone sufficiently low to avoid formation of excessive amounts of carbon dioxide and to prevent fusion of the oil shale. Furthermore, knowledge of the locus of the combustion and retorting zones as they advance through the retort allows monitoring the performance of a retort. Knowledge of the locus of the combustion and retorting zones also allows optimization of the rate of advancement to produce hydrocarbon products with the lowest expense possible by varying the composition of an introduction rate of the retort inlet mixture.

Although this invention has been described in considerable detail with reference to certain versions thereof, other versions of this invention can be practiced. For example, although the invention has been described in terms of a single in situ oil shale retort containing both a combustion processing zone and a retorting processing zone, it is possible to practice this invention with a retort containing only one processing zone, either a combustion or retorting zone. In addition, although FIG. 1 shows a retort where the combustion and retorting zones are advancing downwardly through the retort, this invention is also useful for retorts where the combustion and retorting zones are advancing upwardly or transverse to the vertical.

Also, even though the drawings show retorts having a plurality of radionuclide sources, it can be useful to have only one radionuclide source. Furthermore, although FIG. 1 shows the monitoring instruments 38, 40 below ground in the horizontal drift 20 from the bottom of the retort 12, monitoring instruments can be provided at any location such as above ground for operating and maintenance convenience.

Because of variations such as these, the spirit and scope of the appended claims should not be limited to the description of the preferred versions contained herein.

A method for determining the locus of a processing zone within an in situ retort using indicators, including indicators such as halogen-containing compounds and radionuclides, and apparatus for containing such indicators are disclosed in co-pending U.S. patent applications; Ser. No. 801,631, filed on May 31, 1977, by Robert S. Burton III and Carl Chambers, entitled CONTAINERS FOR INDICATORS, now U.S. Pat. No. 4,149,592; Ser. No. 798,376, filed on May 9, 1977, by Robert S. Burton III, entitled USE OF CONTAINERS FOR DOPANTS TO DETERMINE THE LOCUS OF A PROCESSING ZONE IN A RETORT, now abandoned; and Ser. No. 869,668, filed on Jan. 16, 1978, by Robert S. Burton III, entitled DOPING A RETORT TO DETERMINE THE LOCUS OF A PROCESSING ZONE, now U.S. Pat. No. 4,148,529; and all assigned to the assignee of this invention.

Although the method herein, claiming a method for determining a locus of a processing zone using a radionuclide source as an indicator, is disclosed in the co-pending applications, such co-pending applications are not prior art references as the method herein was developed prior to the filing dates of the applications.

What is claimed is:

1. A method for determining the locus of a processing zone advancing through a fragmented permeable mass of formation particles in an in situ oil shale retort in a subterranean formation containing oil shale, the retort having an effluent gas produced therein and withdrawn therefrom, the method comprising the steps of:

placing at a selected location within the boundaries of a retort at least one radionuclide source for providing radionuclide in the vapor phase at the temperature and pressure of the effluent gas, wherein such radionuclide source provides radionuclide at a predetermined temperature greater than ambient;

advancing a processing zone through the fragmented mass to produce such an effluent gas which is withdrawn from the retort and to provide radionuclide from such radionuclide source at a predetermined temperature; and monitoring effluent gas from the retort for presence of such radionuclide.

2. A method as claimed in claim 1 wherein a plurality of radionuclide sources are placed at selected locations within the boundaries of a retort to be formed and wherein each radionuclide source provides a radionuclide different from the radionuclide provided by any adjacent radionuclide sources.

3. A method as claimed in claim 2 wherein at least three radionuclide sources spaced apart from each other are in a plane substantially normal to the direction of advancement of the processing zone.

4. A method as claimed in claim 3 wherein a plurality of planes are formed and spaced apart from each other along the direction of advancement of a processing zone.

5. A method as claimed in claim 4 wherein the radionuclide sources within a given plane provide the same radionuclide.

6. A method as claimed in claim 5 wherein the radionuclide sources in adjacent planes provide different radionuclides.

7. A method as claimed in claim 4 wherein each radionuclide source provides a different radionuclide than any adjacent radionuclide source.

8. A method as claimed in claims 2, 6, or 7 wherein the different radionuclides provided by the radionuclides are different concentrations of $Kr^{85}$ in the radionuclide sources.

9. A method as claimed in claim 1 wherein the radionuclide source provides $Kr^{85}$ as the radionuclide.

10. A method for determining the locus of at least one processing zone advancing through a fragmented permeable mass of formation particles containing oil shale in an in situ oil shale retort in a subterranean formation, the fragmented mass having a combustion processing zone advancing therethrough and a retorting processing zone advancing therethrough on the advancing side of the combustion processing zone, and wherein an effluent fluid consisting of an off gas portion and a liquid portion is withdrawn from said fragmented mass on the advancing side of the retorting processing zone, the method comprising the steps of:

placing at least one radionuclide source for providing radionuclide at a selected location within the fragmented mass in the retort, wherein at least a portion of the radionuclide provided by the radionuclide source is in the effluent fluid at the temperature and pressure of the effluent fluid, and wherein such a radionuclide source provides radionuclide at a predetermined temperature greater than ambient; and monitoring the effluent fluid withdrawn from the retort for presence of such radionuclide.

11. A method as claimed in claim 10 wherein at least a portion of the radionuclide provided by the radionuclide source is in the gaseous phase at the temperature and pressure of the off gas and such off gas withdrawn from the retort is monitored for the presence of such radionuclide.

12. A method as claimed in claim 10 wherein at least a portion of the radionuclide provided by the radionuclide source is in the liquid phase at the temperature and pressure of the liquid in the effluent fluid and such liquid portion of the effluent fluid withdrawn from the retort is monitored for the presence of such radionuclide.

13. A method as claimed in claim 10 wherein a plurality of radionuclide sources comprising at least one first and at least one second radionuclide source are placed at selected locations in the in situ retort, wherein such a first radionuclide source provides a first radionuclide at a temperature characteristic of the combustion processing zone, and such a second radionuclide source provides a second radionuclide at a temperature characteristic of the retorting processing zone.

14. A method as claimed in claim 13 wherein the first radionuclide provided by the first radionuclide sources is different from the second radionuclide provided by the second radionuclide sources, and the effluent fluid is monitored for both first and second radionuclides.

15. A method as claimed in claim 14 wherein each first radionuclide source provides a distinct first radionuclide dependent upon the location of such first radionuclide source within the retort and each second radionuclide source provides a distinct second radionuclide dependent upon the location of such second radionuclide source within the retort.

16. A method as claimed in claim 14 wherein at least three first radionuclide sources spaced apart from each other are in a plane substantially normal to the direction of advancement of the combustion processing zone.

17. A method as recited in claim 16 wherein a plurality of planes are formed and spaced apart from each other along the direction of advancement of the combustion processing zone.

18. A method as claimed in claim 17 wherein the first radionuclide sources within a given plane provide the same first radionuclide.

19. A method as claimed in claim 18 wherein the first radionuclide sources in adjacent planes provide different first radionuclide.

20. A method as claimed in claim 17 wherein each first radionuclide source provides a different first radionuclide than any adjacent radionuclide source.

21. A method as claimed in claim 14 wherein at least three second radionuclide sources spaced apart from each other are in a plane substantially normal to the direction of advancement of the retorting processing zone.

22. A method as claimed in claim 21 wherein a plurality of planes are formed and spaced apart from each other along the direction of advancement of the retorting processing zone.

23. A method as claimed in claim 22 wherein the second radionuclide sources within a given plane provide the same second radionuclide.

24. A method as claimed in claim 23 wherein the second radionuclide sources in adjacent planes provide different second radionuclide.

25. A method as claimed in claim 22 wherein each second radionuclide source provides a different second radionuclide than any adjacent radionuclide source.

26. A method as claimed in claims 10, 11, 14, 15, 19, 20, 24 or 25 wherein the different radionuclides provided by the radionuclide sources are different concentrations of $Kr^{85}$ in the radionuclide sources.

27. In a method for determining the locus of a processing zone advancing through a fragmented permeable mass of formation particles in an in situ oil shale retort in the subterranean formation containing oil shale, the retort having an effluent gas produced therein and withdrawn therefrom, by the steps of:

placing at a selected location within the boundaries of a retort to be formed in the formation at least one indicator container for providing an indicator at a predetermined temperature greater than ambient, advancing a processing zone through the fragmented mass for producing an effluent fluid which is withdrawn from the retort and for providing indicator from such indicator container at a predetermined temperature, and monitoring the effluent fluid from the retort for presence of such indicator, the improvement comprising the steps of:

placing a radionuclide as an indicator within an indicator container prior to placing the indicator container within the retort; and monitoring effluent fluid from the retort for presence of such radionuclide.

28. A method as recited in claim 27 wherein each indicator container contains krypton-85.

29. A method as recited in claim 28 wherein each indicator container contains a concentration of $Kr^{85}$ different from the concentration in any other container.

* * * * *

UNITED STATES PATENT AND TRADEMARK OFFICE

CERTIFICATE OF CORRECTION

PATENT NO. : 4,249,603

DATED : February 10, 1981

INVENTOR(S) : Haven S. Skogen

It is certified that error appears in the above—identified patent and that said Letters Patent is hereby corrected as shown below:

Column 7, line 34, "zone" second occurrence should be -- form --.
Column 7, line 59, "radionuclide" should be -- radionuclides --.
Column 8, line 8, "and" (second occurrence) should be -- the --;
Column 8, line 52, "K85" should be -- $Kr^{85}$ --.
Column 9, line 8, "as" should be -- a --;
Column 9, line 24, "36C" should be -- 36A --;
Column 9, line 59, "means" should be -- mass --.
Column 10, line 31, "cause" should be -- because --;
Column 10, line 61, "Stamping" should be -- Stemming --.
Column 13, line 8, "9-1/2" should be -- 4-1/2 --.
Column 14, line 12, "of the fill hole 61 in the plug 60A" should be deleted;
Column 14, line 30, "radionuclide" should be -- radionuclides --.

Signed and Sealed this

*Fifth* Day of *May 1981*

[SEAL]

*Attest:*

RENE D. TEGTMEYER

*Attesting Officer* *Acting Commissioner of Patents and Trademarks*